US007121005B2

(12) United States Patent
Hughes

(10) Patent No.: US 7,121,005 B2
(45) Date of Patent: Oct. 17, 2006

(54) HAND HELD DEVICE COMPRISING A HANDLE AND AN OPERATIONAL MEMBER WHICH FOLDS INTO AND OUT OF A SIDE OF THE HANDLE

(76) Inventor: Mark Hughes, 29 Craig House, Hartington Road, London W13 8QJ (GB)

( * ) Notice: Subject to any disclaimer, the term of this patent is extended or adjusted under 35 U.S.C. 154(b) by 0 days.

(21) Appl. No.: 10/628,764

(22) Filed: Jul. 28, 2003

(65) Prior Publication Data

US 2004/0020057 A1 Feb. 5, 2004

(30) Foreign Application Priority Data

Jul. 31, 2002 (GB) ..... 0217753.3
Jan. 31, 2003 (GB) ..... 0302284.5

(51) Int. Cl.
*B26B 1/02* (2006.01)

(52) U.S. Cl. ..... 30/158; 30/155; 30/160

(58) Field of Classification Search ..... 30/158, 30/160, 161, 155; 81/3.45, 3.47, 440, 443, 81/455, 427.5, 177.6, 177.4; 7/128–131
See application file for complete search history.

(56) References Cited

U.S. PATENT DOCUMENTS 5,815,927 A * 10/1998 Collins ..... 30/161
5,964,036 A * 10/1999 Centofante ..... 30/161
6,079,106 A * 6/2000 Vallotton ..... 30/161
6,360,443 B1 * 3/2002 Remus ..... 30/158
6,651,344 B1 * 11/2003 Cheng ..... 30/160
2003/0070299 A1 * 4/2003 Frazer ..... 30/161

* cited by examiner

*Primary Examiner*—Stephen Choi
(74) *Attorney, Agent, or Firm*—Iandiorio & Teska

(57) ABSTRACT

A hand held device (2) comprising a handle (4), an operational member (6), a control member (10) for controlling the folding of the operational member (6), an arm (12) which connects the control member (10) to the operational member (6), a guide groove (14) which guides the control member (10), a first connecting formation (16) which connects the arm (12) to the operational member (6), and a second connecting formation (18) which connects the operational member (6) to the handle (4), movement of the control member (10) along the guide groove (14) causes the folding of the operational member (6) via the arm (12), in its closed condition operational member (6) is folded into the handle (4) the first connecting formation (16) is further away than the second connecting formation (18) from a first end (20) of the handle (4) that is farthest from both the first and second connecting formations (16, 18), and in its open condition the first connecting formation (16) is nearer than the second connecting formation (18) to the first end (20).

12 Claims, 4 Drawing Sheets

HAND HELD DEVICE COMPRISING A HANDLE AND AN OPERATIONAL MEMBER WHICH FOLDS INTO AND OUT OF A SIDE OF THE HANDLE

This invention relates to a hand held device and, more especially, this invention relates to a hand held device comprising a handle and an operational member which folds into and out of a side of the handle. The operational member may be a knife blade, a screwdriver shank, a bottle opening member, or any other suitable and appropriate tool for effecting a desired operation.

Hand held devices comprising a handle and an operational member in the form of a knife blade are well known. The knife blade may move longitudinally into and out of the handle. Alternatively, the knife blade may fold into and out of a side of the handle. Sometimes the knife blades are spring loaded for one-handed operation. The knife blades move very quickly to their open position when a release mechanism is operated. Knives which have spring loaded blade release mechanisms are often known as switch blades or flick knives and they are illegal in many places of the world. Knives are also known which do not have spring loaded blades but which are still able to be operated with one hand. In one common form, a user rotates the knife blade into an open position by positioning the thumb on a control member in the form of a stud positioned on the blade close to the handle, and rotating the knife blade outwardly. Such a mechanism has the disadvantage of requiring user dexterity. In addition, it requires the user to place their thumb only a few millimetres away from the sharp edge of the knife blade.

It is an aim of the present invention to provide a hand held device which obviates or reduces the above mentioned problems.

Accordingly, the present invention provides a hand held device comprising a handle, an operational member which folds into and out of a side of the handle, a control member for controlling the folding of the operational member, an arm which connects the control member to the operational member, a guide grove which is in the handle and which guides the control member over a path which causes the folding of the operational member, a first connecting formation which connects the arm to the operational member, and a second connecting formation which connects the operational member to the handle, the device being such that movement of the control member along the guide groove is done by a person's thumb without assistance from a spring and causes the folding of the operational member into and out of the side of the handle via the arm, the device being such that in its closed condition the operational member is folded into the handle and the first connecting formation is further away than the second connecting formation from a first end of the handle that is farthest from both the first and second connecting formations, and the device being such that in its open condition the operational member is folded out of the handle and the first connecting formation is nearer than the second connecting formation to the first end of the handle.

The device of the present invention is able to be operated with one hand in a simple and safe manner. Still further, the device of the present invention is able to be easily and economically produced compared with many known folding knives with one-handed opening mechanisms.

The device of the present invention is preferably one in which the arm is a flat arm. Other types of arm may however be employed if desired.

The handle is preferably a thin handle. Thus, for example, the handle may be a flat handle. If desired, the handle may be one having convex surfaces. Generally, the handle may be of any suitable and appropriate shape.

The first and second connecting formations may be separate members such for example as pins, or they may be formations which are integral with other parts of the device. Generally, any suitable and appropriate means may be employed for the first and the second connecting formations.

The device of the present invention can be made in a wide variety of materials including moulded plastics materials and metals. The particular material chosen will usually depend upon the intended use of the device but the operational member will normally be made of a metal. Preferably the metal will be stainless steel but other metals may be employed as may be suitable and appropriate.

Advantageously, the device includes releasable locking means for releasably locking the operational member in the open position.

The releasable locking means is preferably a leaf spring. Usually the leaf spring will be located in the handle. This type of locking mechanism is a known type of releasable locking means and is known as a liner lock. An alterative releasable locking means is a spring loaded arm on a spine part of the device. Such a releasable locking means is a known type of releasable locking means and one which is known under the name of a lock back. A further alternative releasable locking means is a locking stud which is positioned at an end of the guide groove nearest the first end of the handle. A still further alternative releasable locking means is a notch in the guide groove. Generally, any suitable and appropriate type of locking means may be employed in the device of the present invention.

The device of the present invention may include stop means for limiting the opening movement of the operational member. The stop means can then be effective to stop the operational member opening too far, for example during use of the device. The stop means may be an abutment on the handle. Other types of stop means may be employed if desired.

The operational member may be a knife blade, in which case the device is then a folding knife. The operational member may alternatively be a screwdriver shank, in which the case the device is then a folding screwdriver. The operational member may be a bottle opening member, in which case the device is then a folding bottle opener. Generally, the operational member may be any suitable and appropriate type of tool for effecting a desired purpose.

If desired, the device of the present invention may have more than one operational member. Each one of these operational members may be extended from the handle by using its own opening mechanism comprising a control member, arm, guide groove, and first and second connecting formations. Thus, for example, the hand held device may have a first operational member operated by a first one of the opening mechanisms, a second operational member operated by a second one of the opening mechanisms, and a third operating member which does not open and shut by means of one of the operating mechanisms but is opened some other way, for example simply by a person using their fingers.

Embodiments of the invention will now be described solely by way of example and with reference to the accompanying drawings in which.

Figure 1:
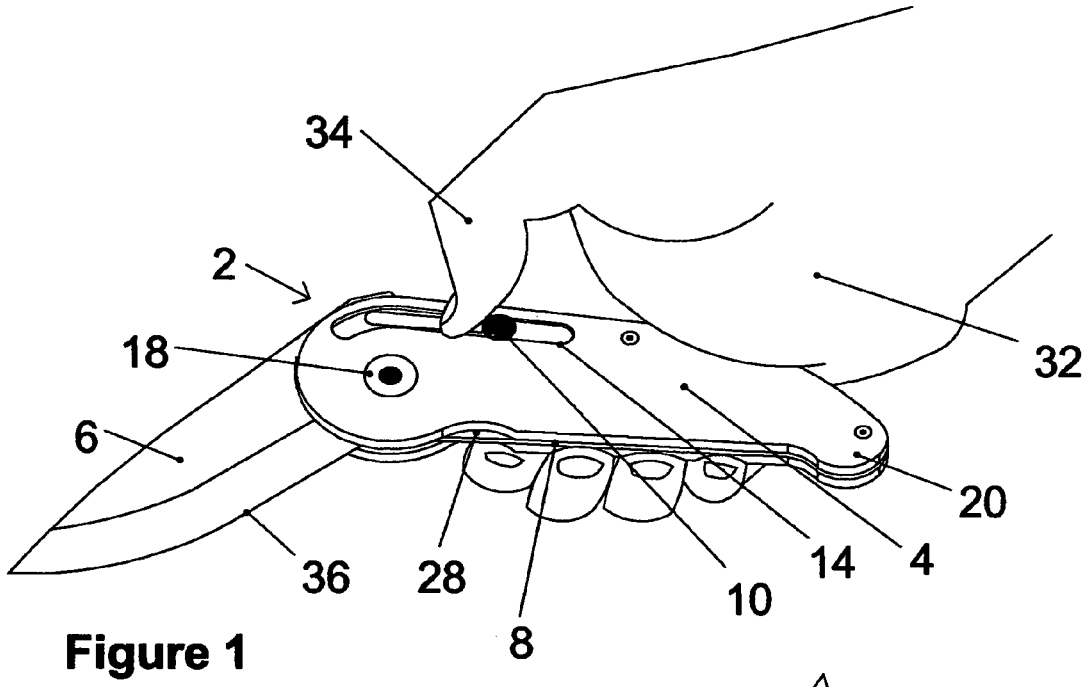
FIG. 1 shows a hand held device in the form of a folding knife being moved to an open position.

Referring to FIGS. 1–9, there is shown a hand held device in the form of a knife 2. The knife 2 comprises a handle 4, and an operational member in the form of a blade 6 which folds into and out of a side 8 of the handle 4. A control member 10 controls the folding of the blade 6. An arm 12 connects the control member 10 to the blade 6. A guide groove 14 is provided in the handle 4 and it guides the control member 10 over a path which causes the folding of the blade 6. A first connecting formation 16 connects the arm 12 to the blade 6. A second connecting formation 18 connects the blade 6 to the handle 4.

Figure 2:
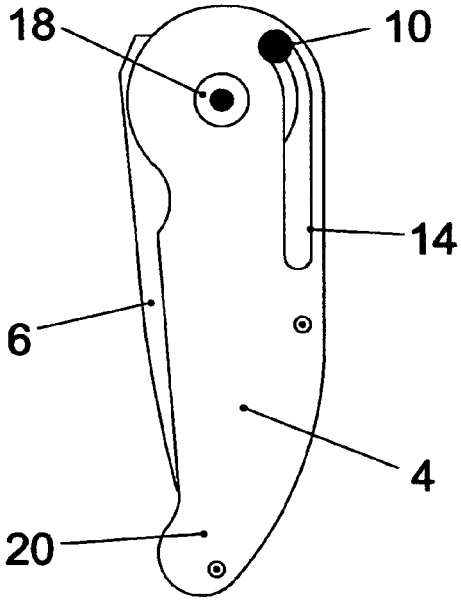
FIG. 2 shows the knife of FIG. 1 in a closed position.
Figure 3:
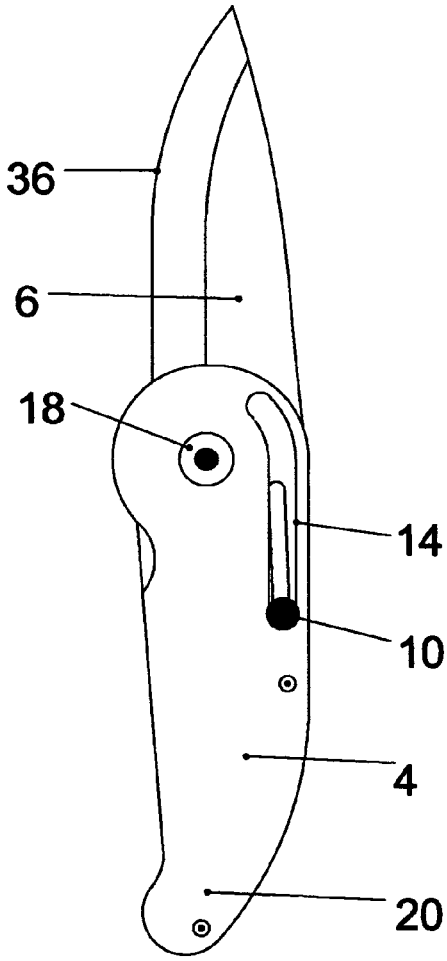
FIG. 3 shows the knife of FIG. 1 in an open position.
Figure 8:
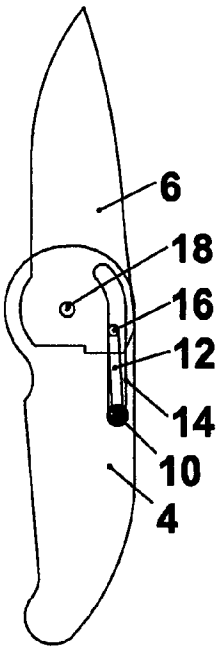
FIGS. 4–8 show an operational member forming part of the knife of FIG. 1 as it moves from its closed position as shown in FIG. 2 to its open position as shown in FIG. 3.
Figure 7:
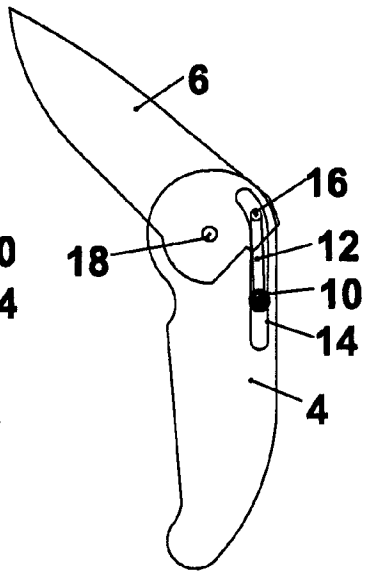
Figure 6:
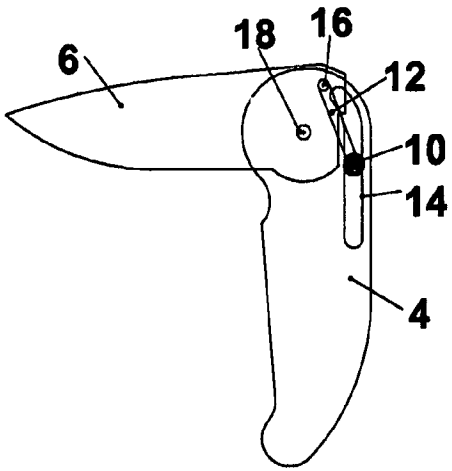
Figure 5:
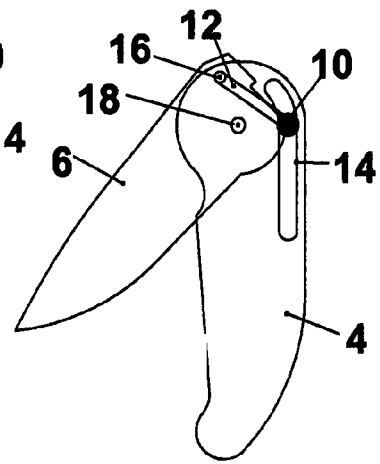
Figure 4:
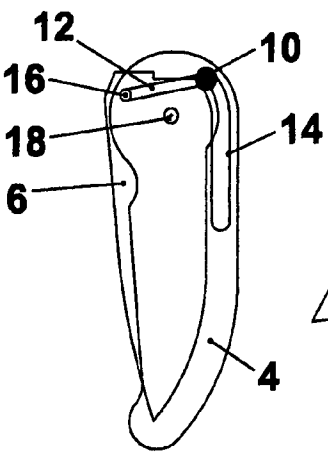

The knife 2 is such that movement of the control member 10 along the guide groove 14 causes the folding of the blade via the arm 12. As shown in FIG. 2, the knife 2 is also such that in its closed condition, the blade 6 is folded into the handle 4, and the first connecting formation 16 is further away than the second connecting formation 18 from a first end 20 of the handle 4 that is remote from both the first and the second connecting formations 16, 18. As shown in FIG. 3, the knife 2 is further such that in its open condition, the blade 8 is folded out of the handle 4, and the first connecting formation 16 is nearer than the second connecting formation 18 to the first end 20 of the handle 4.

Figure 9:
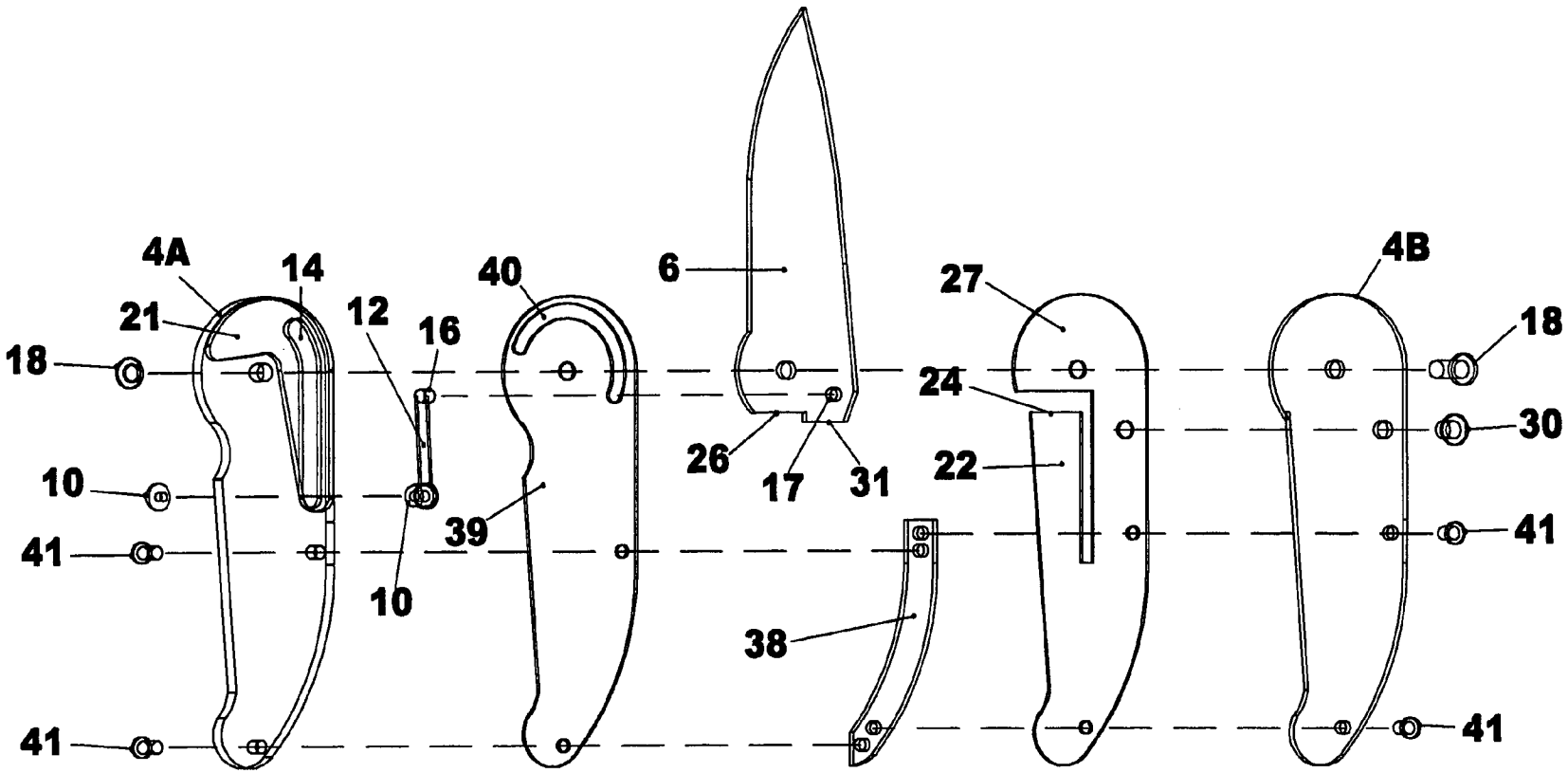
FIG. 9 is an exploded view of the components of the knife shown in FIG. 1.

The arm 12 is a flat arm. The handle 4 is a thin flat handle. The knife 2 includes releasable locking means in the form of a leaf spring 22 for releasably locking the blade 6 in the open position. The leaf spring 22 is located in the handle 4. The shape of the leaf spring 22 is best seen in FIG. 9. An end 24 of the leaf spring 22 engages an end 26 of the blade 6 in order to effect the locking action. In order to unlock the blade 4, the leaf spring 22 is depressed by pushing on an area 28 which extends outwardly from the side 8 of the handle 4. The pushing on the area 28 causes the end 24 to depress and become out of alignment with the end 26 of the blade 6. The blade 6 can then be folded by hand to its closed position.

The knife 2 includes stop means 30 for limiting the opening movement of the blade 6. The stop means 30 is formed by a member 30 which extends perpendicular to a liner 27 and which connects with an area 31 at the base of the blade 6 when the knife 2 is in its open condition.

As can be seen from FIG. 9, the knife 2 also includes a position 17 on the blade 6 where the first connecting formation 16 is attached. A spine 38 joins two handle sections 4A, 4B which then form the completed handle 4. Screws 41 maintain the two handle sections 4A, 4B together. A guard 39 is provided for giving additional strength to the handle 4 if required. A groove 40 in the guard 39 allows the first connecting formation 16 to pass through the guard 39 and move through its arc as the blade 6 is opened. Fastening members 41 hold the knife 2 together. The fastening members 41 may be machine screws, allen screws, or rivets. The fastener members 41 extend into the spine 38 from one exterior side of the handle 4, passing through the guard 39 on the upper side, and passing through the liner 27 on the lower side.

The knife 2 is able to be easily and simply opened with one hand as shown by the hand 32 in FIG. 1. More specifically, the control member 10 is moved by the thumb 34. Since the knife 2 is not spring-loaded, the knife 2 is compliant with existing legislation governing the production and sale of knives in most jurisdictions.

Known spring loaded knives can open accidentally as the release trigger is usually just a button which is depressed, or some other mechanism requiring little movement. To counter this, some known knives have a safety mechanism which both adds complexity and cost to the construction of the knife, and also makes operation more difficult. The knife 2 has neither of these problems as the control member 10 must be moved a considerable distance and with some appreciable force before the blade 6 begins to open. There is normally enough friction to stop the blade 6 swinging open by itself and dragging the control member 10 with it.

Also, when the thumb 34 is on the control member 10, it will be noticed that the thumb 34 is clear for the sharp edge 36 of the blade 6. With pressure being applied by the thumb 34 to the control member 10, even if the thumb 34 should slip off the control member 10 under the application of the pressure, there is no danger of the thumb 34 slipping into the blade 6 and becoming cut on the sharp edge 36. This is an advantageous contrast to many known side opening knives which have a control member located close to the blade edge. On most known folding knives as currently used, there is what is referred to as an "opening stud" which is a small protrusion fixed to the blade somewhere relatively close to the handle at the top of the blade (i.e. near the edge opposite the cutting edge). The distance from the top edge to the cutting edge will vary according to the design of the blade, but a person's thumb will always be a few millimetres from the cutting edge. This gives rise to the following problems, any one of which may result in a nasty cut.

1) A person may not contact the opening stud with their thumb correctly, in which case the lower part of the thumb close to the hand will come very close to the cutting edge as the blade approaches the fully open position.
2) The thumb may slip off the opening stud midway through opening the blade, leaving the blade half-opened and unlocked. This gives two separate problems:
   a) The blade is unlocked and may close on the fingers.
   b) The unconscious reaction is to start the thumb movement from scratch, swinging the thumb through an arc until it hits the opening stud, and then completing the opening movement. Instead of finding the opening stud, the thumb may well contact the cutting edge of the blade which now crosses that arc.

The knife 2 solves problems 1 and 2*b* above. Problem 2*a* can be solved by using a different locking mechanism, and one which will also lock the blade to halfway through the opening arc.

The knife 2 can simply be made and it only has two moving parts. The simplicity of design enables the knife 2 to be produced at an advantageous economical cost compared with known folding knives with single handed opening mechanisms.

Figure 10:
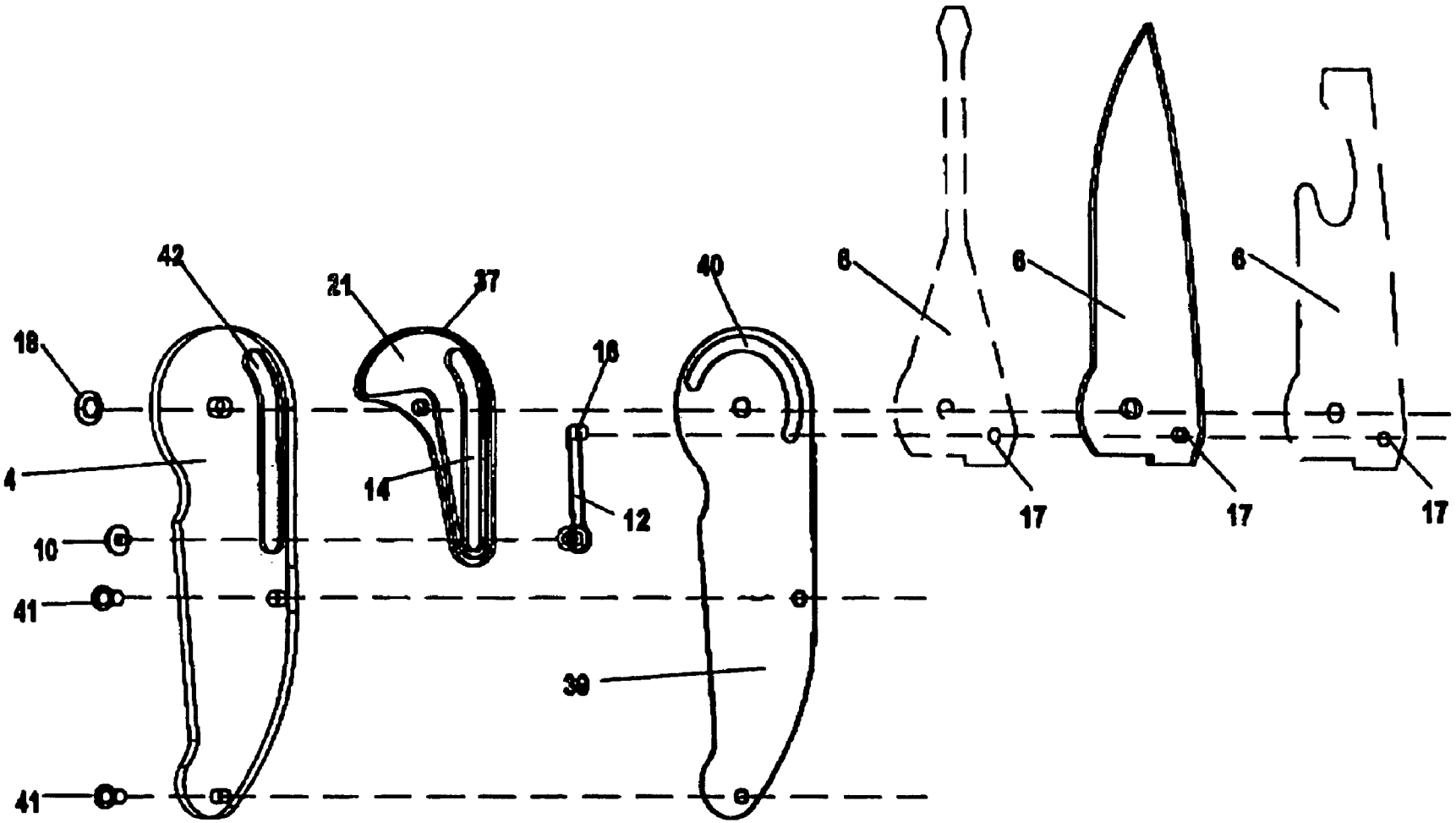
FIG. 10 is an exploded view of an alternative construction for part of the knife shown in FIG. 1.

Referring now to FIG. 10, there is shown an exploded view of an alternative construction for the top part of the handle, the control mechanism, and the blade 6. Similar parts as in FIGS. 1–9 have been given the same reference numerals for ease of comparison and understanding. In FIG. 10, there is a part 37 which combines the guide groove 14 and a cavity 21. The part 37 allows the handle 4 to be made of a softer material than the part 37. The part 37 will usually be made of a metal that will not wear quickly. A hole 42 is provided in the handle 4. The part 37 passes through the hole 42 so that the guide groove 14 is accessible from the outer surface of the handle 4.

It is to be appreciated that the embodiments of the invention described above with reference to the accompanying drawings have been given by way of example only and that modifications may be effected. Thus, for example, an alternative releasable locking means to the leaf spring 22 may be employed so that the releasable locking means may be a lock back device. The operational member may be something other than blade so that, for example, the operational member could be any suitable and appropriate type of tool including a screwdriver shank or a bradawl shank.

The invention claimed is:

1. A hand held device comprising a handle, an operational member which folds into and out of a side of the handle, a control member for controlling the folding of the operational member, an arm which connects the control member to the operational member, a guide groove which is in the handle and which guides the control member over a path which causes the folding of the operational member, a first connecting formation which connects the arm to the operational member, and a second connecting formation which connects the operational member to the handle, the device being such that movement of the control member along the guide groove is done by a person's thumb without assistance from a spring and causes the folding of the operational member into and out of the side of the handle via the arm, the device being such that in its closed condition the operational member is folded into the handle and the first connecting formation is further away than the second connecting formation from a first end of the handle that is farthest from both the first and second connecting formations, and the device being such that in its open condition the operational member is folded out of the handle and the first connecting formation is nearer than the second connecting formation to the first end of the handle.

2. A hand held device according to claim 1 in which the arm is a flat arm.

3. A hand held device according to claim 1 in which the handle is a flat handle.

4. A hand held device according to claim 1 and including releasable locking means for releasably locking the operational member in the open position.

5. A hand held device according to claim 4 in which the releasable locking means is a leaf spring which is located in the handle.

6. A hand held device according to claim 4 in which the releasable locking means is a spring loaded arm on a spine pert of the device.

7. A hand held device according to claim 4 in which the releasable locking means is a locking stud which is positioned at an end of the guide groove nearest the first end of the handle.

8. A hand held device according to claim 4 in which the releasable locking means is a notch.

9. A hand held device according to claim 1 and including stop means for limiting the opening movement of the operational member.

10. A hand held device according to claim 9 in which the stop means is an abutment on the handle.

11. A hand held device according to claim 1 in which the operational member is selected from the group consisting of a knife blade, a screwdriver shank, and a bottle opening member.

12. A hand held device according to claim 1 in which there is more than one operational member.

* * * * *